US010047534B2

(12) United States Patent
Matsudo et al.

(10) Patent No.: US 10,047,534 B2
(45) Date of Patent: Aug. 14, 2018

(54) METHOD FOR MODIFYING CONCRETE SLAB ON SUBSIDED GROUND

(71) Applicant: UPCON Corporation, Kawasaki-shi (JP)

(72) Inventors: Nobukazu Matsudo, Kawasaki (JP); Koji Kawaguchi, Kawasaki (JP)

(73) Assignee: UPCON CORPORATION, Kawasaki-shi (JP)

( * ) Notice: Subject to any disclaimer, the term of this patent is extended or adjusted under 35 U.S.C. 154(b) by 0 days.

(21) Appl. No.: 15/387,969

(22) Filed: Dec. 22, 2016

(65) Prior Publication Data

US 2017/0342730 A1 Nov. 30, 2017

(30) Foreign Application Priority Data

May 31, 2016 (JP) ..... 2016-109632

(51) Int. Cl.
*E04G 23/02* (2006.01)

(52) U.S. Cl.
CPC ..... *E04G 23/0288* (2013.01)

(58) Field of Classification Search
CPC ..... E04G 23/0288
USPC ..... 52/127.3
See application file for complete search history.

(56) References Cited

U.S. PATENT DOCUMENTS 1,915,032 A * 6/1933 Poulter ..... E01C 23/10 104/11
4,567,708 A * 2/1986 Haekkinen ..... E01C 23/10 404/78
6,521,673 B1 * 2/2003 Brown ..... C08G 18/4804 404/78
6,976,804 B1 * 12/2005 Asplin ..... E01C 23/10 404/78
8,092,116 B1 * 1/2012 Asplin ..... E01C 23/10 404/78
8,186,907 B1 * 5/2012 Asplin ..... E01C 23/10 404/78
2016/0305076 A1 * 10/2016 Doan ..... B28D 1/14
(Continued)

FOREIGN PATENT DOCUMENTS

JP 2010-126955 A 6/2010

OTHER PUBLICATIONS

International Search Report for International Application No. PCT/JP2017/020184 dated Sep. 5, 2017 (2 Sheets).

*Primary Examiner* — Charles A Fox
*Assistant Examiner* — James Buckle, Jr.
(74) *Attorney, Agent, or Firm* — Kratz, Quintos & Hanson, LLP

(57) ABSTRACT

An object of the present invention is to provide a method for accurately modifying a concrete slab on subsided ground by injecting an expandable resin below the concrete slab more than once, which also allows for easy control of the work process. The method of the present invention as a means for resolution includes performing the following steps: on a concrete slab in an area including a region where ground subsidence has occurred, determining points to drill injection holes for injecting an expandable resin at a pitch of 0.5 to 2.0 m in a grid pattern; injecting an expandable resin below a point where the subsidence of the concrete slab is severest and expanding the expandable resin to push up the concrete slab at most 30 mm more than once.

6 Claims, 1 Drawing Sheet

(56) References Cited

U.S. PATENT DOCUMENTS

2016/0376752 A1* 12/2016 Yun ..... E01C 7/147
404/75

* cited by examiner

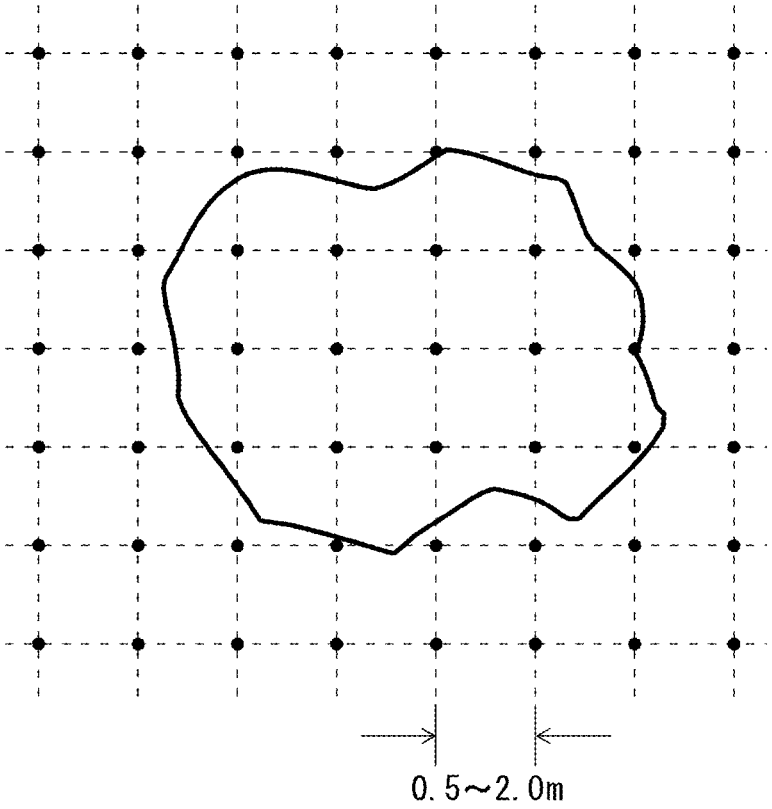
0.5~2.0m

METHOD FOR MODIFYING CONCRETE SLAB ON SUBSIDED GROUND

TECHNICAL FIELD

The present invention relates to a method for modifying a concrete slab on subsided ground.

BACKGROUND ART

In recent years, ground subsidence due to various causes has been affecting concrete slabs, which serve as the substructure for building structures, such as factories, warehouses, stores, and houses, and civil engineering structures, such as roads, docks and ports, bridges, and airports, resulting in problematic damages. When ground subsidence occurs due to, for example, a pumping of a large amount of underground water as factory water from a weak ground zone, an upwelling of a large amount of water resulting from the development of underground tunnels, insufficient compaction of the soil on reclaimed land from the ocean or large-scale developed land, or the like, concrete slabs are inclined. This causes problems in that the behavior of machines installed in the building structure is affected, or shelves are inclined, obstructing the cargo handling work. In addition, when cracking occurs due to the inclination of a concrete slab, this causes a situation where vehicles and carts cannot run. As a method for modifying a concrete slab to deal with these problems, a method in which an expandable resin is injected into an inside of subsided ground or a space formed between the ground and a concrete slab, and the expandable resin is expanded to push up the concrete slab to a predetermined height, is known (e.g., Patent Document 1).

PRIOR ART DOCUMENTS

Patent Document

Patent Document 1: JP-A-2006-144269

SUMMARY OF THE INVENTION

Problems that the Invention is to Solve

According to the method utilizing an expandable resin described in Patent Document 1, it is not necessary to demolish the structure in order to modify the concrete slab. Thus, such a method is convenient and economical, and the opportunity of use has been increasing year by year. However, in the case where ground subsidence has occurred over a wide region, when an expandable resin is injected only once, the expandable resin does not sufficiently spread into the inside of subsided ground or the space formed between the ground and a concrete slab. Accordingly, the injection of the expandable resin has to be performed more than once. In this case, the quality of the concrete slab after modification is significantly affected by from which position, in what kind of order, and how the expandable resin is injected, and these factors are also important in controlling the work process.

Thus, an object of the present invention is to provide a method for accurately modifying a concrete slab on subsided ground by injecting an expandable resin below the concrete slab more than once, which also allows for easy control of the work process.

Means for Solving the Problems

A method for modifying a concrete slab on subsided ground, according to the present invention accomplished in light of the above points, comprising injecting an expandable resin therebelow from an injection hole drilled in the concrete slab, includes, as defined in claim 1, steps of: on a concrete slab in an area including a region where ground subsidence has occurred, determining points to drill injection holes for injecting an expandable resin at a pitch of 0.5 to 2.0 m in a grid pattern; specifying, from the determined points, a point where the subsidence of the concrete slab is severest; injecting an expandable resin therebelow from an injection hole drilled in the specified point; and expanding the expandable resin to push up the concrete slab at most 30 mm, sequentially followed by steps of: specifying a point where the subsidence of the concrete slab is severest after the previous step has been performed; injecting an expandable resin therebelow from an injection hole drilled in the specified point; and expanding the expandable resin to push up the concrete slab at most 30 mm, thereby making the entire concrete slab a predetermined height.

A method as defined in claim 2 is such that in the method defined in claim 1, after the need for pushing up the concrete slab has been eliminated by previous steps, an expandable resin is injected below at least one point below which no expandable resin has yet been injected, and the expandable resin is expanded to fill a space that may be present therebelow and/or compact the ground therebelow.

Effect of the Invention

According to the present invention, a method for accurately modifying a concrete slab on subsided ground by injecting an expandable resin below the concrete slab more than once, which also allows for easy control of the work process, can be provided.

BRIEF DESCRIPTION OF THE DRAWINGS

FIG. 1 A schematic diagram showing an example of a region where ground subsidence has occurred (within the frame), and examples of points (●) for drilling injection holes for injecting an expandable resin, which are determined in a grid pattern on a concrete slab in an area including the region.

MODE FOR CARRYING OUT THE INVENTION

The present invention is a method for modifying a concrete slab on subsided ground, comprising injecting an expandable resin therebelow from an injection hole drilled in the concrete slab. The method includes steps of: on a concrete slab in an area including a region where ground subsidence has occurred, determining points to drill injection holes for injecting an expandable resin at a pitch of 0.5 to 2.0 m in a grid pattern; specifying, from the determined points, a point where the subsidence of the concrete slab is severest; injecting an expandable resin therebelow from an injection hole drilled in the specified point; and expanding the expandable resin to push up the concrete slab at most 30 mm, sequentially followed by steps of: specifying a point where the subsidence of the concrete slab is severest after the previous step has been performed; injecting an expandable resin therebelow from an injection hole drilled in the specified point; and expanding the expandable resin to push up the concrete slab at most 30 mm, thereby making the entire concrete slab a predetermined height.

In the method of the present invention, points for drilling injection holes for injecting an expandable resin below the concrete slab are determined at a pitch of 0.5 to 2.0 min a grid pattern on the concrete slab in an area including a region where ground subsidence has occurred (see FIG. 1). The reason why the points are set not only inside but also outside the region where ground subsidence has occurred is as follows. Outside the region where ground subsidence has occurred, for example, there may be places where, although the concrete slab is not inclined (thus the concrete slab does not have to be pushed up), a space is present therebelow or the ground therebelow is weak due to ground subsidence. In such places, it is desirable that an expandable resin is injected and expanded, thereby filling the space or compacting the ground. The points are set at a pitch of 0.5 to 2.0 m in a grid pattern so that, under easy control of the work process, the expandable resin will be injected and expanded below the concrete slab uniformly in and around the region where ground subsidence has occurred. In the case where the pitch between a point and a point is more than 2.0 m, even when an expandable resin is injected below two adjacent points, it may happen that the expandable resin does not spread below the gap between the points, causing a situation where a space or weak ground remains there. Such a problem can be solved by reducing the pitch between a point and a point. However, even when the pitch is made less than 0.5 m, it may happen that the expandable resin that has been injected below the adjoining point also spreads below such a point, whereby it becomes unnecessary to inject an expandable resin below the point, or a work burden is caused due to an increase in the number of steps.

In the method of the present invention, from the determined points, a point where the subsidence of the concrete slab is severest is specified, and an expandable resin is injected therebelow from an injection hole drilled in the specified point. Therefore, every time the injection of an expandable resin is performed, the point where the subsidence of the concrete slab is severest is specified using a laser leveling machine or the like. Usually, the point where the subsidence of the concrete slab is severest is present inside the region where ground subsidence has occurred. Even when an expandable resin has already been injected below a point as a point where the subsidence of the concrete slab is severest, in the case where such a point is subsequently specified again as a point where the subsidence of the concrete slab is severest, an expandable resin is again injected therebelow. The degree of pushing up of the concrete slab by a single injection of an expandable resin is at most 30 mm. When the concrete slab is pushed up more than 30 mm, a local excessive load is applied to the concrete slab, whereby cracking may occur. In addition, it may happen that when an expandable resin is subsequently injected below another point and expanded to push up the concrete slab in that point, at the same time, the concrete slab is unnecessarily pushed up in order to relax the load, causing a situation where the difference in height between the two points is not reduced. It is suitable that the degree of pushing up of the concrete slab by a single injection of an expandable resin is 10 to 20 mm. When the degree of pushing up of the concrete slab by a single injection of an expandable resin is too small, the injection of an expandable resin has to be repeated again and again.

The drilling of injection holes in points for injecting an expandable resin therebelow may be performed every time a point is specified as a point where the subsidence of the concrete slab is severest, or may also be previously performed in all or some of the determined points. Drilling may be performed using a drill, for example, in a region having a diameter of 10 to 50 mm. The injection of an expandable resin from an injection hole may be performed using an injection gun known per se. It is desirable that the injection hole from which an expandable resin has been injected is closed with unshrinkable mortar, for example.

It is desirable that after the need for pushing up the concrete slab has been eliminated by the above steps, that is, after the entire concrete slab has made a predetermined height, an expandable resin is injected below at least one point below which no expandable resin has yet been injected, and the expandable resin is expanded, thereby filling a space that may be present therebelow and/or compacting the ground therebelow. With respect to a point to be subjected to this step, in the case where the drilling of injection holes in points for injecting an expandable resin therebelow is performed every time a point is specified as a point where the subsidence of the concrete slab is severest, the point to be subjected can be easily distinguished as a point that has not been drilled and is in the state of being marked on the concrete slab. In addition, also in the case where the drilling of injection holes in points for injecting an expandable resin therebelow is previously performed in all or some of the determined points, by checking whether there is an expanded expandable resin in each injection hole, whether such a point has an expandable resin injected therebelow can be easily distinguished (in an injection hole from which an expandable resin has been injected, an expanded expandable resin is present). Furthermore, when injection holes from which an expandable resin has been injected are closed with unshrinkable mortar or the like every time the injection is performed, a point to be subjected to this step can be easily distinguished as an unclosed point.

The expandable resin used in the method of the present invention may be any kind as long as it can be injected into an inside of subsided ground or a space formed between the ground and a concrete slab and expanded to push up the concrete slab, and can also withstand the weight loaded on the modified concrete slab. However, CFC-free expandable resins, which do not cause global warming and are environment-friendly, are particularly preferable. Examples of CFC-free expandable resins include commercially available products made of a polyol and an isocyanate, which react to produce urethane foam without generating CFC gas (specifically, a combination of CFC-free polyol FF5020-UC and isocyanate NP-90, both manufactured by Nihon Puftem Co., Ltd., can be mentioned). As such a CFC-free expandable resin, a polyol and an isocyanate mixed in a weight ratio of 1:0.8 to 1.5 at 20 to 70° C. can be used. Examples of CFC-free expandable resins also include, in addition to those made of a polyol and an isocyanate, a resin that produces carbon dioxide foam as a result of the reaction between water and an isocyanate, a resin that foams utilizing liquefied carbon dioxide, and a hydrocarbon-based resin having foaming characteristics.

INDUSTRIAL APPLICABILITY

According to the present invention, a method for accurately modifying a concrete slab on subsided ground by injecting an expandable resin below the concrete slab more than once, which also allows for easy control of the work process, can be provided. In this respect, the present invention is industrially applicable.

The invention claimed is:

1. A method for modifying a concrete slab on subsided ground, comprising injecting an expandable resin therebelow from an injection hole drilled in the concrete slab, the method including steps of: on a concrete slab in an area including a region where ground subsidence has occurred, determining points to drill injection holes for injecting an expandable resin at a pitch of 0.5 to 2.0 m in a grid pattern; specifying, from the determined points, a point where the subsidence of the concrete slab is severest; injecting an expandable resin therebelow from an injection hole drilled in the specified point; and expanding the expandable resin to push up the concrete slab at most 30 mm, sequentially followed by subsequent sets of steps, wherein each set of the subsequent sets of steps comprises the steps of: specifying a subsequent point where the subsidence of the concrete slab is severest after the previous step set of steps has been performed; injecting an expandable resin therebelow from an injection hole drilled in the specified subsequent point; and expanding the expandable resin to push up the concrete slab at most 30 mm, thereby making the entire concrete slab a predetermined height.

2. The method according to claim 1, wherein after the need for pushing up the concrete slab has been eliminated by previous steps, an expandable resin is injected below at least one point below which no expandable resin has yet been injected, and the expandable resin is expanded to fill a space that may be present therebelow and/or compact the ground therebelow.

3. The method according to claim 1, wherein the step of determining points to drill the injection holes for injecting the expandable resin includes points not only inside but also outside the region where the ground subsidence has occurred.

4. The method according to claim 1, wherein each step of injecting the expandable resin to push up the concrete slab at most 30 mm is by a single injection of the expandable resin.

5. The method according to claim 1, wherein the step of specifying a point where the subsidence of the concrete slab is severest includes the step of using a leveling machine.

6. The method according to claim 5, wherein the step of using a leveling machine for specifying a point where the subsidence of the concrete slab is severest includes the step of using a laser leveling machine.

* * * * *